US006858059B2

(12) United States Patent
Yamamoto et al.

(10) Patent No.: US 6,858,059 B2
(45) Date of Patent: Feb. 22, 2005

(54) ELECTRON BEAM MELTING METHOD FOR METALLIC MATERIAL

(75) Inventors: Norio Yamamoto, Chigasaki (JP); Katsuhiko Sakai, Chigasaki (JP)

(73) Assignee: Toho Titanium Co., Ltd., Kanagawa (JP)

( * ) Notice: Subject to any disclaimer, the term of this patent is extended or adjusted under 35 U.S.C. 154(b) by 83 days.

(21) Appl. No.: 10/279,867

(22) Filed: Oct. 25, 2002

(65) Prior Publication Data

US 2003/0084751 A1 May 8, 2003

(30) Foreign Application Priority Data

Oct. 26, 2001 (JP) ..... 2001-329212

(51) Int. Cl.[7] ..... C22B 9/22
(52) U.S. Cl. ..... 75/10.65
(58) Field of Search ..... 75/10.65

(56) References Cited

U.S. PATENT DOCUMENTS 4,627,148 A * 12/1986 Imahashi et al. ..... 29/516
5,226,946 A * 7/1993 Diehm et al. ..... 75/10.14

FOREIGN PATENT DOCUMENTS

JP 62176667 8/1987
JP 09031559 2/1997

* cited by examiner

*Primary Examiner*—Melvyn Andrews
(74) *Attorney, Agent, or Firm*—Antonelli, Terry, Stout & Kraus, LLP

(57) ABSTRACT

An electron beam melting method for a metallic material which is melted by an electron beam in a melting furnace is disclosed. The method comprises: locating an actual melting material and a pre-melting material in the melting furnace; forming a melted surface on the pre-melting material by an electron beam under a reduced pressure; and melting the actual melting material by the electron beam while maintaining the reduced pressure in the melting furnace.

15 Claims, 3 Drawing Sheets

ELECTRON BEAM MELTING METHOD FOR METALLIC MATERIAL

BACKGROUND OF THE INVENTION

1. Field of the Invention

The present invention relates to an electron beam melting method for metallic materials, in particular, relates to a melting method which can restrict increase of oxygen concentration in produced metallic ingots by producing metallic ingots by an electron beam melting method, thereby the ingots being widely useful in technical fields such as semiconductor materials which require severely restricted oxygen content.

2. Description of the Related Art

In an electron beam melting method for metallic materials, an electron beam is emitted onto a metallic material in a vacuum to melt the material, the melted material is charged into a crucible cooled by water for solidification. The open bottom of the crucible is closed by a starting block, which is moved downwardly so as to continually extract the coagulated metallic material to produce an ingot. The electron beam melting method is widely used for producing high melting point materials such as W, Nb, and Mo, active materials such as Ti, and highly pure Cu.

When an electron beam is emitted onto the material and the temperature of the material is increased, heat radiates from the material. A large amount of moisture and gases in the air adheres to the inner walls and surfaces of several parts in a melting furnace before the melting of the metallic material, and a certain portion of the adhered moisture and gases remain in the melting furnace even if the interior of the furnace is evacuated. The remaining moisture and the gases are separated from the surfaces of the inner walls and the parts and are discharged into the interior of the melting furnace. As a result, portions of the discharged moisture and gases are absorbed into the melted material, thereby increasing the oxygen concentration.

The adhered moisture and gases are intensely discharged at the beginning of the melting, and the amount thereof is gradually reduced as the melting is proceeded. When the amount of radiated heat is large, the adhered moisture and gases are intensely discharged, and the amounts thereof are reduced in a short time. Therefore, in a case of electron beam melting of materials with strong affinity for oxygen, such as Ti and Zr, the oxygen concentration may exceed 50 ppm in a portion produced at the beginning of the melting. Such a portion with high oxygen concentration deteriorates workability and reliability and may be cut and removed, thereby decreasing the yield efficiency.

In order to restrict increase of the oxygen concentration, Japanese Patent First Publication No. 9-31559 discloses pre-melting the same material as the melting material. However, the publication only discloses a pre-melting method using a water cooled tray type melting vessel (in section [0024]), and the problems such as decrease of the yield efficiency and increase of the oxygen concentration remain unsolved.

SUMMARY OF THE INVENTION

Therefore, it is an object of the present invention to provide an electron beam melting method for a metallic material, in which the yield efficiency can be increased and the oxygen concentration can be restricted in melting a metallic material by emitting an electron beam.

The present invention provides an electron beam melting method for metallic material which is melted by an electron beam in a melting furnace, comprising: locating an actual melting material and a pre-melting material in the melting furnace; forming a melted surface on the pre-melting material by an electron beam under a reduced pressure; and melting the actual melting material by the electron beam while maintaining the reduced pressure in the melting furnace.

In the electron beam melting method for metallic material, a metalic material for the pre-melting is melted by the electron beam under a reduced pressure, so that moisture and gases discharged in the interior of the melting furnace by the radiant heat generated in the pre-melting are absorbed in the melted material of the pre-melting material. The actual material is melted by the electron beam under conditions in which the amounts of the moisture and the gases in the melting furnace are reduced after moving the pre-melting material, and absorption of the moisture and the gases into the actual melting material can be inhibited. In the invention, the pre-melting material can be used several times in the pre-melting, and the yield efficiency can be increased.

DESCRIPTION OF THE PREFERRED EMBODIMENT

An embodiment of the present invention will be described hereinafter with reference to the drawings.

According to a preferred embodiment, a pre-melting material is located in a crucible, a melted surface is formed on an upper surface of the pre-melting material by the electron beam; the pre-melting material is removed from the crucible after cooling and solidifying it; the actual material is melted by the electron beam to produce a melted material; and the melted material is provided into the crucible. In such a embodiment, the pre-melting material and the actual melting material are separated from each other, and contamination of the actual material by moisture and gases can be effectively inhibited.

In the above embodiment, the crucible may have an opening in the bottom thereof, and the opening may be closed by a starting block movable in the vertical direction. The pre-melting material is preferably located on the starting block. The starting block may be raised so as to coincide the upper surface thereof with the upper surface of the crucible, then the pre-melting material is horizontally moved in removing the pre-melting material from the crucible after cooling and solidifying it. Such a process enables the use of existing apparatuses as they are.

As the actual melting materials and the pre-melting materials, high melting point materials such as W, Nb, V, and Mo; active materials such as Ti, Zr, and Hf; and Cu can be mentioned. Among these materials, Ti and Zr having strong affinity with oxygen are suitable for the electron beam melting.

In the electron beam melting method in the present invention, the pre-melting material can be dissimilar from the actual melting material. However, the actual melting material may be contaminated due to vaporization of the pre-melting material since a portion of the pre-melting material is also melted by the electron beam. Therefore, the pre-melting material is preferably approximately the same material as the actual melting material. The pre-melting material absorbs or adheres moisture and gases in the melting furnace so as to remove them, and is preferably a metal which easily absorbs moisture and gases, in particular, preferably Ti or Zr.

Figures 1A, 1B:
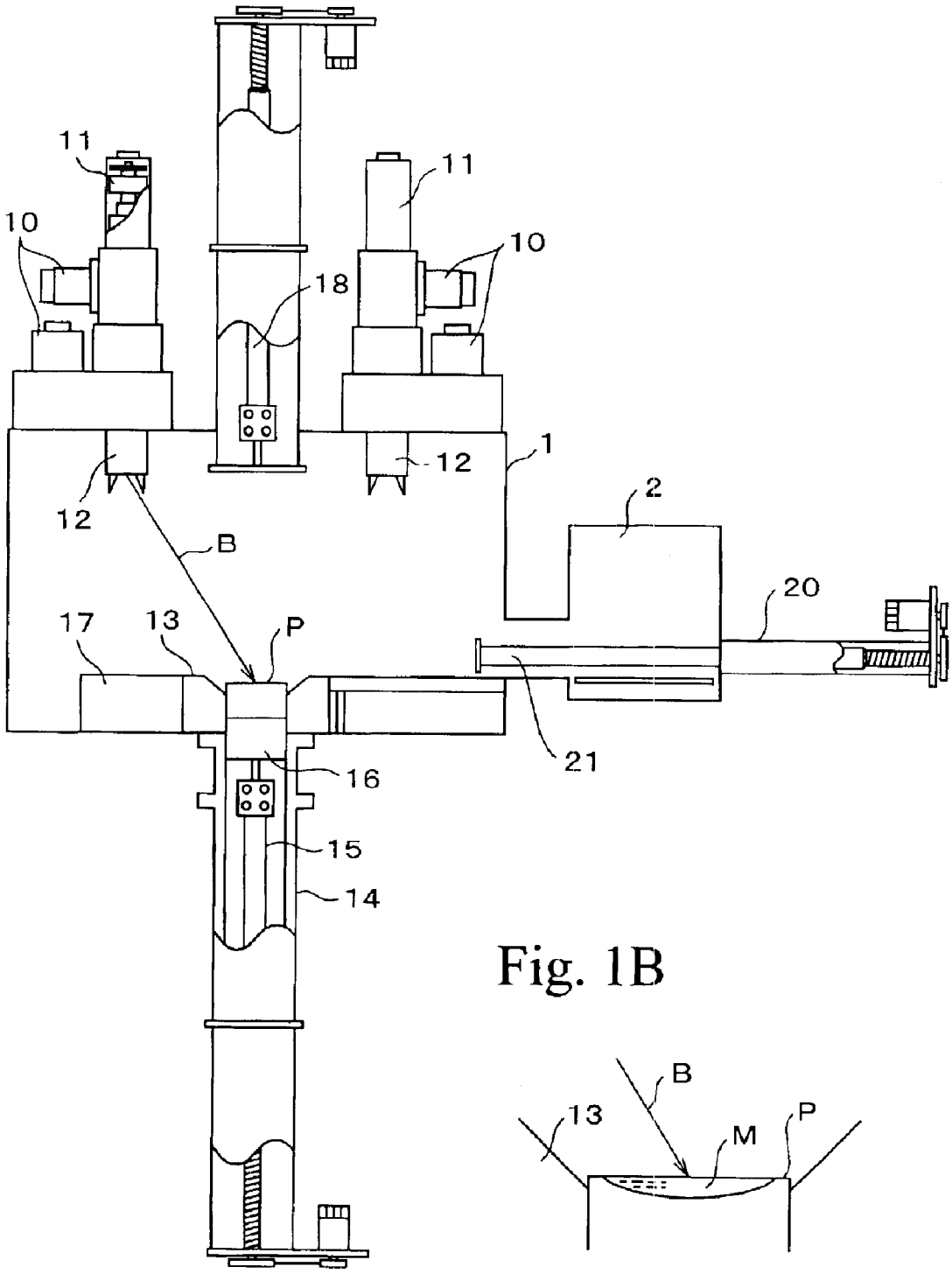
FIG. 1A is a cross section of an electron beam melting furnace showing electron beam melting according to an embodiment of the invention.
FIG. 1B is an enlarged cross section of a pre-melting material.

In the invention, the operation for melting a portion of the pre-melting material and the operation for melting the actual melting material as a raw melting material are continuously performed in a vacuum, and the pre-melting material and the actual melting material must be located beforehand in an electron beam melting furnace. FIG. 1A shows an embodiment of such an electron beam melting furnace. The reference numeral 1 in FIG. 1 indicates a furnace body, reference numeral 2 indicates a material magazine; these form a vacuum chamber and communicated with each other.

A vacuum pump 10 is attached to the upper portion of the furnace body 1. An electron beam generator 11 is attached to the upper portion of the furnace body 1. An electron gun 12 is provided at the lower portion of the electron beam generator 11. A ring-shaped crucible 13 is located at the bottom of the furnace body 1. The crucible 13 is made from a material having good heat conductivity, such as copper, and cooling water flows in the interior thereof. A ring-shaped cooling mechanism 14 is provided at the lower side of the crucible 13. The inner diameter of the cooling mechanism 14 is the same as that of the crucible 13. The wall portion of the cooling mechanism 14 is also hollow, and cooling water flows in the interior thereof. An extracting mechanism 15 is provided in the cooling mechanism 14. A starting block 16 is attached to the upper end portion of the extracting mechanism 15. The starting block 16 is made from approximately the same material as the metallic material for active melting, and has a size suitable for closing the opening formed at the bottom of the crucible 13.

A material feeder 20 is attached to the lower side end of the material magazine 2. A feeder shaft 21 is provided in the material feeder 20. The feeder shaft 21 pushes the actual melting material contained in the material magazine 2 in the left in the figure. The reference numeral 17 is a mount, and the height thereof coincides with that of the crucible 13. Reference numeral 18 is a lifting mechanism, which may lift the actual melting material to immediately above the crucible 13 for electron beam melting in another embodiment.

Steps for electron beam melting for a metallic material composed of, for example, a Ti briquette, in the above electron beam melting furnace will be explained with reference to FIGS. 1A to 3B. First, the starting block 16 is positioned at the lower end of the crucible 13, and a pre-melting material P made from Ti is carried on the starting block 16. Then, the vacuum pump 10 is started. When the interior of the furnace body 1 reaches to a predetermined vacuum degree, an electron beam B is emitted from the electron gun 12 onto the center of the upper surface of the pre-melting material P, whereby the upper surface of the pre-melting material P is melted. In this operation, only a portion of the upper surface in the pre-melting material P is melted. If the lower end portion of the pre-melting material P is melted, the pre-melting material P is bonded to the starting block 16 at the lower side, and the pre-melting material P cannot be moved. Therefore, the pre-melting material P should have a certain thickness and a melt surface should be formed so as not to reach the melting to the lower end of the pre-melting material P.

The pressure in the furnace body 1 in the pre-melting is controlled at $8.0\times10^{-3}$ Pa or less. When the pre-melting is started, moisture and gases in the furnace body 1 are vaporized or discharged and the pressure therein increases. When the melting output is increased and further melting is performed, the pressure further increases. Then, the pressure gradually decreases and returns to the predetermined pressure since moisture and the like in the furnace body 1 is absorbed in the pre-melting material P. Therefore, the pre-melting is preferably continued until the pressure in the furnace body 1 returns to the predetermined pressure.

Figure 2:
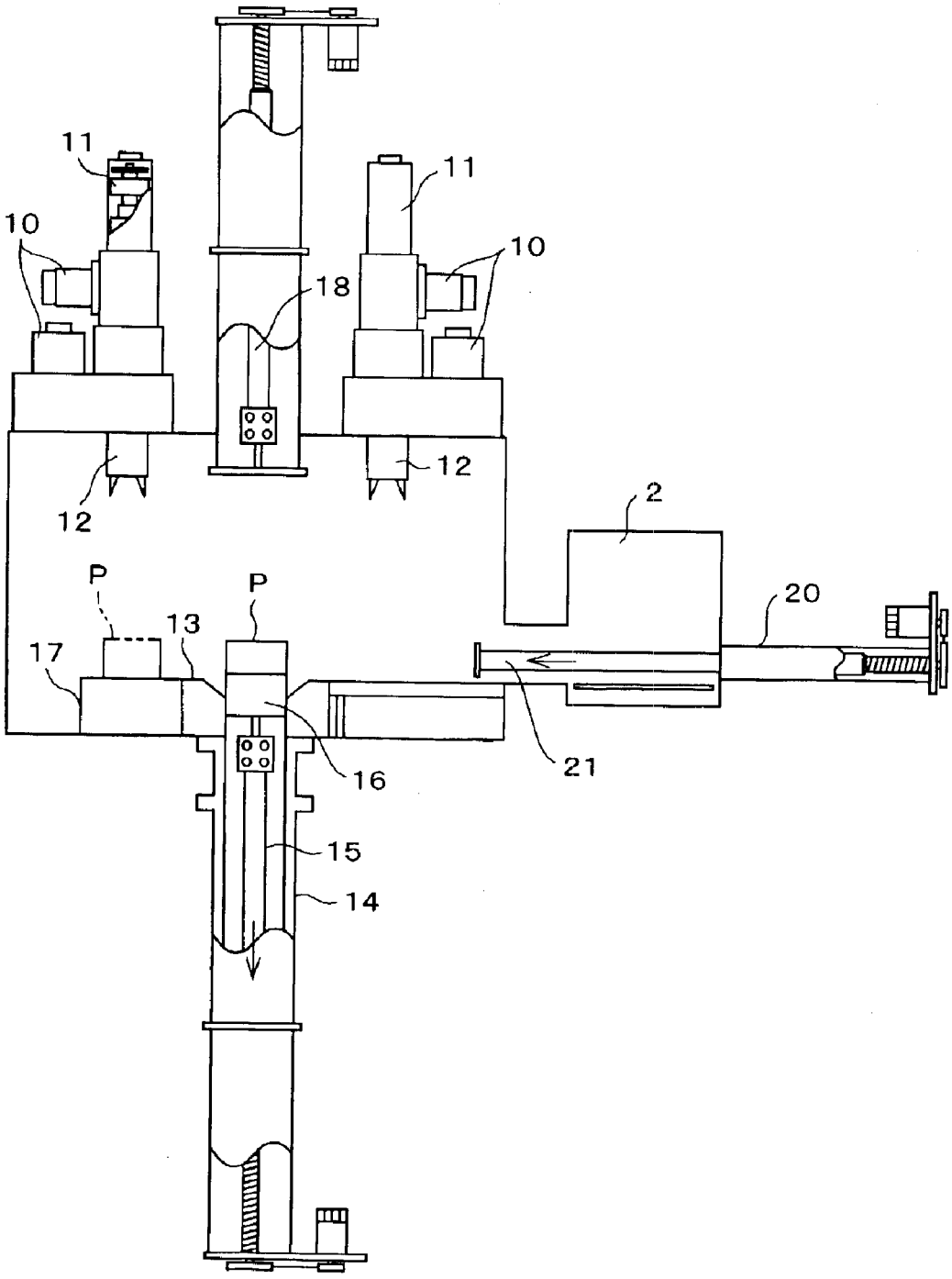
FIG. 2 is a cross section of an electron beam melting furnace according to an embodiment of the invention, and shows a condition in which a starting block is raised from the condition in FIG. 1.
Figures 3A, 3B:
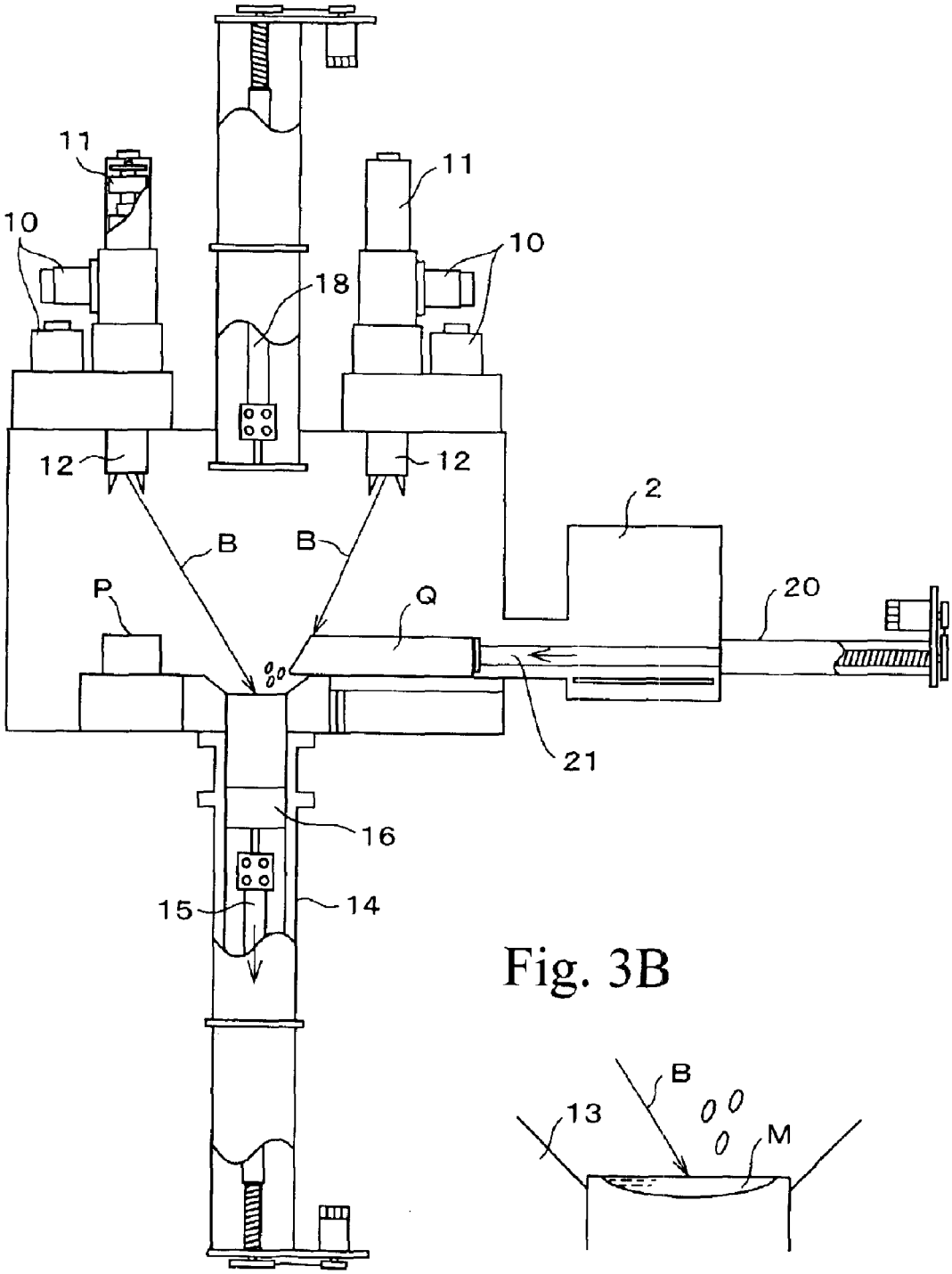
FIG. 3A is a cross section of an electron beam melting furnace showing actual melting according to an embodiment of the invention.
FIG. 3B is an enlarged cross section of a melted material produced by the actual melting.

Next, emission of the electron beam B is stopped and the melted material M is cooled and solidified. Then, the starting block 16 is raised and the upper surface thereof is brought level with the upper surface of the crucible 13 as shown in FIG. 2. In this condition, the feeder shaft 21 of the material feeder 20 is advanced, thereby moving the pre-melting material P from the starting block 16 to the mount 17. Next, the starting block 16 is moved downwardly to the condition shown in FIG. 1A. The actual melting material Q contained in the material magazine 2 is dropped to the feeding position, and the feeder shaft 21 is advanced so as to face the front end of the actual material Q to the crucible 13 (see FIG. 3A). In this condition, the electron beam B is emitted from the electron gun 12 onto the upper surface of the starting block 16 so as to melt the entire upper surface thereof, then the electron beam B is emitted onto the front edge of the actual melting material Q. Thus, the front edge of the actual material Q is melted, and the produced melted material drops into the crucible 13, that is, on the upper surface of the starting block 16.

The above operation is performed while maintaining the vacuum condition. If the vacuum condition is reestablished, air and moisture enter from outside into the furnace, and metallic material is contaminated while the actual melting material is melted. Since the melted material dropped into the crucible 13 is cooled and solidified therein, the electron beam B is emitted onto the center of the melted material, thereby maintaining the melted condition for a portion of the upper surface. By such an operation, impurities having lower melting points than that of the actual melting material and included in the material are vaporized, and the purity of the metallic material is improved. Then, the extracting mechanism 15 is driven to gradually move the starting block 16 downwardly, and the metallic material is extracted downwardly when the solidification is carried out.

In the electron beam melting method for metallic material as above, the pre-melting material P is melted before melting the actual melting material Q, of which radiant heat leaves moisture in the air and gases adhered to the inner walls and surfaces of several parts in the melting furnace. A portion of the moisture and the like is absorbed into the melted material M of the pre-melting material P, and the remaining portion is discharged out of the system. Although heat radiation occurs in the actual melting after taking out the pre-melting material P from the crucible 13, moisture and gases adhered to the inner walls and the like have been left by the pre-melting, whereby very small amounts of moisture and the like will be newly discharged. Therefore, the amount of the moisture and the gases contaminated in the melted material M at the beginning of the actual melting can be reduced, and the purity (in particular, the oxygen concentration) of the yielded metallic material can be improved. The pre-melting material P can be used several times, and the yield efficiency can be improved.

When the radiant heat in the actual melting is large, moisture and gases will be newly discharged. Therefore, the radiant heat in the pre-melting is equal to or larger than the radiant heat in the actual melting. The radiant heat in melting is proportional to power 4 of the melting temperature, and is proportional to the melting area. Therefore, the radiant heat can be increased by setting the output of an electron beam in pre-melting equal to or greater than the output in the actual melting so as to increase the melting temperature, or by setting the melting area in the pre-melting to be equal to or greater than the melting area in the actual melting. It should be noted that the former method requires increase in the cooling capacity in a portion around the melted metal, and the later method is therefore preferable.

In the above embodiment, the actual melting material Q is melted by the electron beam above the crucible 13, but the invention includes an embodiment using a hearth melting furnace in which a water cooled tray type melting vessel is located beside the crucible 13, and an actual melting material Q is melted in the water cooled tray type melting vessel by an electron beam. More specifically, an end of a Ti briquette is melted by an electron beam at a circumference of the water cooled tray type melting vessel so as to charge a melted material therein, and the overflowed melted material is provided in the crucible 13. In this operation, the melted material is also heated by the electron beam so as not to be cooled and solidified. In the embodiment using the hearth melting furnace, a pre-melting material may be melted in the crucible 13.

In another embodiment, the pre-melting may be performed in the water cooled tray type melting vessel. In this embodiment, the pre-melting material is preferably cooled and solidified in the vessel and removed therefrom after pre-melting. Alternately, the pre-melting material may be entirely melted in the water cooled tray type melting vessel, and subsequently, the actual melting may be performed at the circumference of the water cooled tray type melting vessel. In this embodiment, the melted material of the pre-melting material, which has absorbed moisture and gases, may be settled at the bottom of the water cooled tray type melting vessel, so that pure melted material of the actual melting material may be provided to the crucible 13.

EXAMPLES

Next, the present invention will be explained in more detail with reference to examples of the invention. The scope of the invention is not limited to those examples.

Examples of the Invention

The electron beam melting furnace shown in FIG. 1A was cleaned and necessary parts were set. An electron beam melting was performed with the following conditions using a water cooled tray type melting vessel with a diameter of 180 mm and a pressure on the order of $10\times10^{-2}$ Pa or less in the furnace.

First, a starting block with a diameter of 176 mm and a height of 250 mm made from the same material as the pre-melting material (Ti with purity of 99.995%) was inserted into a crucible, and was connected to the extracting mechanism. A pre-melting material (pure Ti, Grade 2) with a diameter of 176 mm and a height of 80 mm was placed on the starting block, and the starting block was vertically moved so that the upper surface of the pre-melting material was positioned at a predetermined position in the crucible. Then, output of the electron beam was gradually increased by 5 kW to 35 kW, and the entire upper surface of the pre-melting material was melted. The output was maintained at each level for 5 minutes. The degree of the vacuum was $3.1\times10^{-3}$ Pa when the output of the electron beam was 0 kW. When the output was increased, the degree of the vacuum was immediately decreased, but the degree of the vacuum was recovered a little after maintaining for 5 minutes. When the output was further increased, the degree of the vacuum was similarly varied. When the output was 35 kW, the degree of the vacuum was decreased to $1.3\times10^{-2}$ Pa at maximum. After maintaining the output, the degree of the vacuum was gradually recovered, and was reached to $4.8\times10^{-3}$ Pa after 40 minutes. Then, the output was stopped, the starting block was raised so as to move the pre-melting material above the crucible, and the pre-melting material was horizontally moved.

Then, the starting block was located at a predetermined position in the crucible, and a metallic material as an actual material was melted. That is, the entire upper surface of the starting block was melted with the same output pattern as in the pre-melting material. The degree of the vacuum was $1.2\times10^{-3}$ Pa when the output of the electron beam was 0 kW. When the output was 35 kW, the degree of the vacuum was decreased to 3.1×10–3 Pa at maximum. After maintaining the output, the degree of the vacuum was gradually recovered, and reached $1.5\times10^{-3}$ Pa after 30 minutes. Then, the emission point of the electron beam was adjusted so as to melt the entire upper surface of the starting block, and the actual melting material was pushed from the side of the crucible to the center thereof. The electron beam was emitted onto the end of the actual melting material, and the melted material was dropped on the starting block. Since the upper surface of the melted material gradually rose according to the dropping of melted material, the starting block was gradually moved downwardly so as to position the upper surface of the melted material. These operations were repeated and a metallic ingot with a diameter of 176 mm and a length of 500 mm was obtained.

The starting block was cut from the ingot, and samples were obtained and the oxygen concentrations thereof were analyzed. These samples were obtained from portions of the cut surface corresponding to the beginning of the melting, portions every 100 mm from the cut surface, and portions corresponding to the end of the melting, for a total of 6 or 7 portions. The result of the analysis is shown in Table 1. As is clear from Table 1, the amount of increased oxygen concentration was highest at 10 ppm at the cut surface corresponding to the beginning of the melting, but increased oxygen concentration was not observed at the portions 100 mm or more apart from the cut surface.

TABLE 1

| | Increased Oxygen Concentration (wt. ppm) | | | | | | |
|---|---|---|---|---|---|---|---|
| Analyzed Portion | Cut Surface | 100 mm | 200 mm | mm | 400 mm | 500 mm | End of Melting |
| Examples | | | | | | | |
| No. 1 | 10 | 0 | 0 | 0 | 0 | 0 | 0 |
| No. 2 | 0 | 0 | 0 | — | — | — | — |

TABLE 1-continued

| Analyzed Portion | Increased Oxygen Concentration (wt. ppm) Cut Surface | 100 mm | 200 mm | mm | 400 mm | 500 mm | End of Melting |
|---|---|---|---|---|---|---|---|
| No. 3 | 10 | 0 | 0 | — | — | — | — |
| Comparative Examples | | | | | | | |
| No. 4 | 60 | 50 | 30 | 10 | 0 | 0 | 0 |
| No. 5 | 80 | 80 | 50 | 20 | 10 | 0 | 0 |

Comparative Examples

The electron beam melting furnace shown in FIG. 1 was cleaned and necessary parts are set. The furnace was evacuated, and an electron beam was emitted onto a starting block with a diameter of 176 mm and a height of 250 mm made from the same material as the required metallic material (Ti with purity of 99.995%) from the beginning without pre-melting, thereby yielding an ingot through the same conditions as the above example. The degree of the vacuum was $3.7\times10^{-3}$ Pa when the output of the electron beam was 0 kW. When the output was increased, the degree of the vacuum was immediately decreased, but the degree of the vacuum recovered a little after maintaining for 5 minutes. When the output was further increased, the degree of the vacuum similarly varied. When the output was 35 kW, the degree of the vacuum was decreased to $9.7\times10^{-2}$ at maximum. After maintaining the output, the degree of the vacuum gradually recovered, and reached $5.0\times10^{-3}$ Pa after 30 minutes. Then, the emission point of the electron beam was adjusted so as to melt the entire upper surface of the starting block, and a required metallic material was pushed from the side of the crucible to the center thereof. The electron beam was emitted onto the metallic material so as to melt it, and a required metallic ingot with a diameter of 176 mm and a length of 500 mm was obtained. The starting block was cut from the ingot, and samples were obtained and the oxygen contents thereof were analyzed. The results of the analysis is shown in Table 1. As is clear from Table 1, amount of increased oxygen concentration was the greatest 80 ppm at the cut surface corresponding to the beginning of the melting. Increased oxygen concentration was observed at the portions 100 mm or more apart from the cut surface, and increased oxygen concentration was observed at the portions 400 mm apart from the cut surface.

What is claimed is:

1. An electron beam melting method for metallic material which is melted by the electron beam in a melting furnace, comprising:

locating an actual melting material in the melting furnace;

locating a pre-melting material in a crucible arranged in the melting furnace;

forming a melted surface on the pre-melting material by an electron beam under a reduced pressure;

removing the pre-melting material from the crucible after cooling and solidifying it; and melting the actual melting material by an electron beam and providing the melted material into the crucible while maintaining the reduced pressure in the melting furnace.

2. The electron beam melting method for metallic material according to claim 1, wherein the melted surface is formed on an upper surface of the pre-melting material by the electron beam.

3. The electron beam melting method for metallic material according to claim 1, wherein the pre-melting material is titanium.

4. The electron beam melting method for metallic material according to claim 2, wherein the pre-melting material is titanium.

5. The electron beam melting method for metallic material according to claim 1, wherein the pre-melting material is approximately the same material as the actual melting material.

6. The electron beam melting method for metallic material according to claim 2, wherein the pre-melting material is approximately the same material as the actual melting material.

7. The electron beam melting method for metallic material according to claim 1, wherein the melted surface area of the pre-melting material melted by the electron beam is equal to or larger than the melted surface area of the actual melting material melted by the electron beam.

8. The electron beam melting method for metallic material according to claim 1, wherein the melting power in the pre-melting by the electron beam is equal to or greater than the melting power in the actual melting by the electron beam.

9. The electron beam melting method for metallic material according to claim 1, wherein the molten surface is formed on the pre-melting material after locating the pre-melting material on the starting block which can be moved in a vertical direction.

10. The electron beam melting method for metallic material according to claim 9, wherein the starting block is raised so as to coincide the upper surface thereof with the upper surface of the crucible, and the pre-melting material is horizontally moved in removing the pre-melting material from the crucible after cooling and solidifying it.

11. The electron beam melting method for metallic material according to claim 1, wherein the crucible has a ring-shape through which a starting block is movable, the starting block is raised after the pre-melting material is cooled and solidified, and the pre-melting material is then horizontally pushed and removed from the crucible.

12. The electron beam melting method for metallic material according to claim 1, wherein the melting furnace has a moving device for moving the actual melting material toward the crucible, and the pre-melting material is removed from the crucible by the moving device after cooling and solidifying it.

13. The electron beam melting method for metallic material according to claim 1, wherein the reduced pressure varies during the method.

14. The electron beam melting method for metallic material according to claim 13, wherein the reduced pressure increases at the start of forming a melted surface on the pre-melting material as moisture or gases in the melting furnace are vaporized or discharged, and gradually decreases as moisture or gases in the melting furnace are absorbed tin the pre-melting material.

15. The electron beam melting method for metallic material according to claim 13, wherein the pre-melting material is removed from the crucible when the reduced pressure decreases to a predetermined pressure.

* * * * *